US006326549B1

(12) United States Patent
Kunii et al.

(10) Patent No.: US 6,326,549 B1
(45) Date of Patent: Dec. 4, 2001

(54) TERMINAL-PROCESSED STRUCTURE OF TAPE-SHAPED CABLE INCLUDING PLURALITY OF COAXIAL CABLES ARRANGED IN PARALLEL AND METHOD FOR PROCESSING TERMINAL OF THE SAME

(75) Inventors: Masashi Kunii; Hideki Saito; Hajime Kimura; Takaaki Ichikawa, all of Ibaraki (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

(21) Appl. No.: 09/506,387

(22) Filed: Feb. 18, 2000

(30) Foreign Application Priority Data

Feb. 18, 1999 (JP) ..... 11-040398

(51) Int. Cl.[7] ..... H01R 9/07
(52) U.S. Cl. ..... 174/88 C; 174/117 F
(58) Field of Search ..... 174/117 F, 88 R, 174/84 R, 88 C

(56) References Cited

U.S. PATENT DOCUMENTS 5,206,462 * 4/1993 Iura et al. ..... 174/117 F
5,212,348 * 5/1993 Gibson ..... 174/117 F X
5,665,940 * 9/1997 Chimura et al. ..... 174/117 F X
5,940,963 * 8/1999 Tolmie et al. ..... 174/117 F X

FOREIGN PATENT DOCUMENTS 10-144145 5/1998 (JP) .

* cited by examiner

*Primary Examiner*—Chau N. Nguyen
(74) *Attorney, Agent, or Firm*—McDermott, Will & Emery

(57) ABSTRACT

A method for processing a terminal of a cable including a plurality of fine coaxial cables arranged in parallel and a terminal-processed tape-shaped cable are provided. After sheaths closer to the terminal of a plurality of fine coaxial cables are removed to expose outer conductors, the outer conductors thus exposed are removed in such a way that the entirety of the outer conductors thus exposed are covered with a solder layer, then the solder layer and the outer conductors are separated at a processing groove formed at a predetermined position on this solder layer, and respective portions of the outer conductors closer to the end of the cable relative to the position of the separation are removed in a lump.

2 Claims, 6 Drawing Sheets

TERMINAL-PROCESSED STRUCTURE OF TAPE-SHAPED CABLE INCLUDING PLURALITY OF COAXIAL CABLES ARRANGED IN PARALLEL AND METHOD FOR PROCESSING TERMINAL OF THE SAME

FIELD OF THE INVENTION

The invention relates to a terminal-processed structure of a tape-shaped cable including a plurality of coaxial cables arranged in parallel and a method for processing a terminal of the same, and more particularly to a method for processing a terminal of a fine tape-shaped cable used as a wiring material around a liquid crystal display for a personal computer or a display for an ultrasonic diagnostic apparatus requiring high resolution, and to a terminal-processed structure of the tape-shaped cable.

BACKGROUND OF THE INVENTION

As a wiring material in LCD (liquid crystal display) used for a note-book type personal computer or the like, an FPC (flexible print circuit board) has been used commonly heretofore. Recently, higher speed of image signal processing is required for improving the image quality of LCD. To increase signal processing speed, fine coaxial cables have been applied to wiring around displays in place of FPC.

Tape-shaped cables composed of fine coaxial cables are used more and more as demands for more compact, thinner and lighter personal computers, such as note-book type and portable personal computers, are growing rapidly.

However, for connecting a number of fine coaxial cables with an FPC, a PCB (print circuit board) or a connector terminal, terminal processing of the cable is required so as to ground all of the outer conductors without failure and to keep the inner conductors of respective cores to be positioned in a predetermined pitch. It has been much troublesome to carry out such terminal processing of fine coaxial cables.

In an attempt to solve the problem, a conventional method for processing a terminal of a tape-shaped cable is disclosed in Japanese Patent Application Laid-open No. Hei 10-144145, in which sheaths of the coaxial cables in portions close to the terminal are removed so as to expose outer conductors of the coaxial cables, two grounding metal bars are soldered on the outer conductors thus exposed at respective positions, and one of the metal bars and the outer conductors positioned on the tip side relative to the other metal bar are removed together.

In the conventional method for processing the terminal of the tape-shaped cable, however, there are disadvantages in that the use of two metal bars is laborious and increases the cost for terminal processing because one of the metal bars is discarded together with the removed portions of the outer conductors, and the mechanical and electrical characteristics are not obtained stably in the soldering of the metal bars to the respective outer conductors.

SUMMARY OF THE INVENTION

Accordingly, it is an object of the invention to provide a terminal-processed structure of a tape-shaped cable including coaxial cables having very small diameters arranged in parallel and a method for processing a terminal of the same which ensure, with less cost and labor, grounding of the outer conductors of the cables without failure and the positions of inner conductors at the terminal.

It is another object of the invention to provide a terminal-processed structure of a tape-shaped cable and a method for processing a terminal of the same in which grounding plates are connected in mechanical and electrical stability to outer conductors.

According to the first feature of the invention, a terminal-processed structure of a tape-shaped cable including a plurality of coaxial cables arranged in parallel, comprises:

- inner conductors arranged in parallel with a predetermined pitch;
- insulative layers for insulating the inner conductors except for a predetermined portion thereof, thereby providing exposed inner conductors each having a predetermined length;
- outer conductors provided on the insulative layers except for a predetermined portion thereof, thereby providing exposed insulative layers on both sides of the exposed inner conductors;
- a solder layer for covering the outer conductors, the solder layer having opposite flat surfaces;
- grounding plates soldered to the opposite flat surfaces of the solder layer;
- sheaths provided on outer peripheries of the outer conductors at positions where the solder layer does not cover the outer conductors; and
- insulative tapes for arranging the plurality of coaxial cables in parallel with the predetermined pitch, the insulative tapes adhering to the sheaths, and each coaxial cable including one of the inner conductors, one of the insulative layers, one of the outer conductors, and one of the sheaths.

According to the second feature of the invention, a method for processing a terminal of a cable having a plurality of coaxial cables arranged in parallel, comprises the steps of:

- removing sheaths of the coaxial cables in a portion close to the terminal so as to expose outer conductors of the coaxial cables;
- covering the entirety of outer conductors thus exposed with a solder layer;
- separating the solder layer and the outer conductors into two portions at a predetermined longitudinal position of the solder layer; and
- removing the portion of the solder layer and the outer conductors positioned on the tip side relative to the predetermined longitudinal position, in a lump, so as to expose insulative layers of the coaxial cables.

In a preferred embodiment, the solder layer and the outer conductors are separated at the predetermined longitudinal position by bending the tape-shaped cable up and down in the vertical direction (perpendicular to the longitudinal direction). Alternatively, a groove may be formed in the direction perpendicular to the longitudinal direction of the cable at the predetermined position of the solder layer so that the solder layer and the outer conductors may be cut by pulling or bending them with the fulcrum at the groove thus formed, whereby the solder layer and the outer conductors are separated at the predetermined position. The separation of the outer conductors by the help of groove formed on the solder layer is preferable, taking account of the evenness of the cutting surface.

The groove may be formed by scraping a surface portion of the solder layer by means of a mechanical knife. Alternatively, the groove may be formed by laser processing whereby the solder layer is melted and removed at a position where the laser light is irradiated. The separation of the outer conductors at the grooved position by pulling or bending is performed more easily after laser processing because the solder is also removed between the cables by laser processing to form notches (perforations) in a broken line like a machine-sawing line along the processing groove.

Further, it is preferred that a conductive plate is soldered to be fixed on the flat surface of the solder layer which is left after removal of the separated solder layer and outer conductors, while the pitch of insulative cores is kept by the solder layer. Thus, linearity in the cross-section of the outer conductors is ensured at the processed terminal even if the surface of the separated outer conductors and solder layer is uneven, facilitating the alignment when the terminal-processed tape-shaped cable is applied to a connector.

It is preferred that the exposed portions of insulative layers of the coaxial cables are fixed at a predetermined pitch before they are removed to expose inner conductors of the coaxial cables.

Before use of the terminal-processed tape-shaped cable according to the invention, exposed portions of the insulative layers are removed so that inner conductors of the coaxial cables are exposed.

BRIEF DESCRIPTION OF THE DRAWINGS

The invention will be explained in more detail in conjunction with the appended drawings, wherein.

DESCRIPTION OF THE PREFERRED EMBODIMENTS

A method for processing a terminal of a tape-shaped cable including a plurality of coaxial cables arranged in parallel in a preferred embodiment according to the invention will be explained.

Increased efficiency in terminal processing of coaxial cables is obtained particularly by the procedure shown in the following.

(1) Place a plurality of coaxial cables at a predetermined pitch, and fix the cables with an adhesive tape or the like.
(2) Cut the cables in a predetermined length.
(3) Irradiate laser light to the portion fixed with the adhesive tape to form a slit, pull the sheaths and expose the outer conductors (wrapped shield wires).
(4) Immerse the outer conductors in a solder bath to be soldered in a lump so that the entirety of the outer conductors are covered to be fixed with a solder layer.
(5) Form a processing groove consisting of notches on the solder layer by means of laser light.
(6) Cut the outer conductors by bending the cables up and down with the fulcrum at the processing groove.
(7) Pull mechanically the integrally soldered outer conductors on the end side to remove the outer conductors together with the solder layer in a lump so that the insulative layers are exposed.
(8) Solder a solder-plated conductive metal plate on the remaining portion of the solder layer left.
(9) Adhere a plastic tape on the insulative layers thus exposed to fix the insulated cores at an equal pitch.
(10) Irradiate laser light to the insulative layers at the middle point between the conductive plate and the plastic tape to form slits.
(11) Separate the insulative layers from the inner conductors and shift the insulative layers from the slits to the end side so as to expose the inner conductors.
(12) Cut off the portions of the insulative layers extended out of the plastic tape whereby a terminal-processed tape-shaped cable is completed.

A preferred embodiment of the invention will be explained in detail with reference to FIGS.1 to 10.

Figure 1:
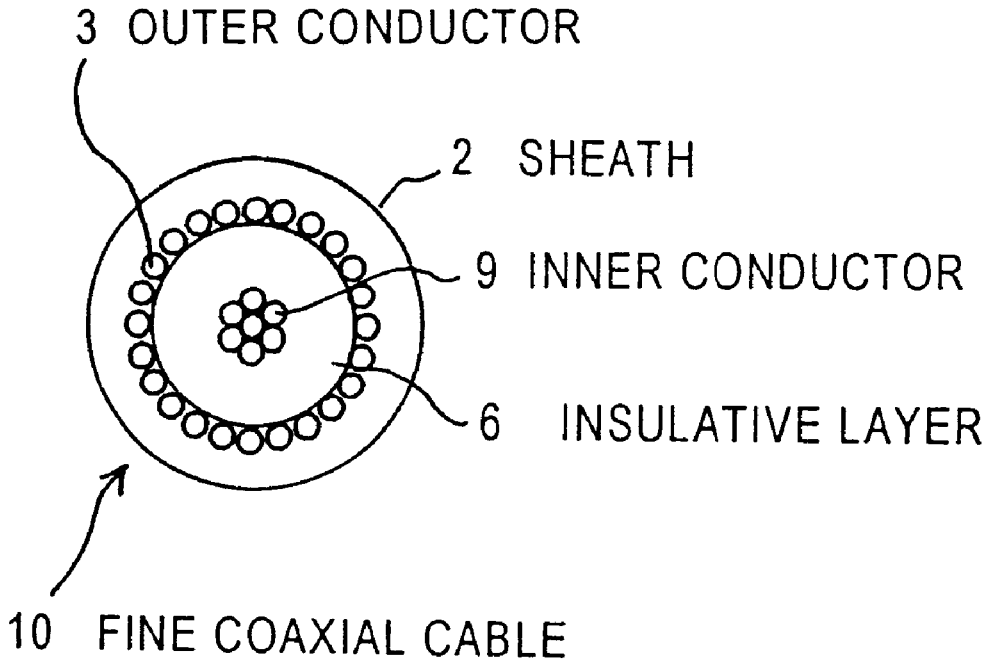
FIG. 1 is a cross-sectional view of a fine coaxial cable.

FIG. 1 is a cross-sectional view of a coaxial cable 10 used here. An inner conductor 9 including seven twisted wires of tin-plated copper-alloy having diameter of 0.03 mm is covered by an insulative layer 6 formed of fluorocarbon resin (PFA) of 0.08 mm in thickness. Insulative layer 6 is covered further by an outer conductor 3 including tin-plated soft copper wires of 0.032 mm in diameter which are wrapped on insulative layer Then, a polyester tape is wound on outer conductor 3 so as to overlap each other to form sheath 2. The outer diameter of coaxial cable 10 is 0.34 mm.

For preparing a tape-shaped cable including coaxial cables as shown in FIG. 1, eleven fine coaxial cables 10 are placed in parallel to each other at a pitch of 0.5 mm. Adhesive tapes 1 are applied to coaxial cables 10 from above and below to fix coaxial cables 10. Thus, a tape-shaped cable 11 is obtained in FIG. 2.

Tape-shaped cable 11 is cut into a length of 150 mm. $CO_2$ laser light is irradiated to the position 15 mm distant from both ends of the tape-shaped cable to form grooves on the cable,wherein one end is only shown in FIGS. 2 to 10. Adhesive tape 1 and sheaths 2 are shifted integrally in the direction to separate out of the cable so as to expose portions of outer conductors 3 (FIG. 2) at an end of tape-shaped cable 11.

Figure 2:
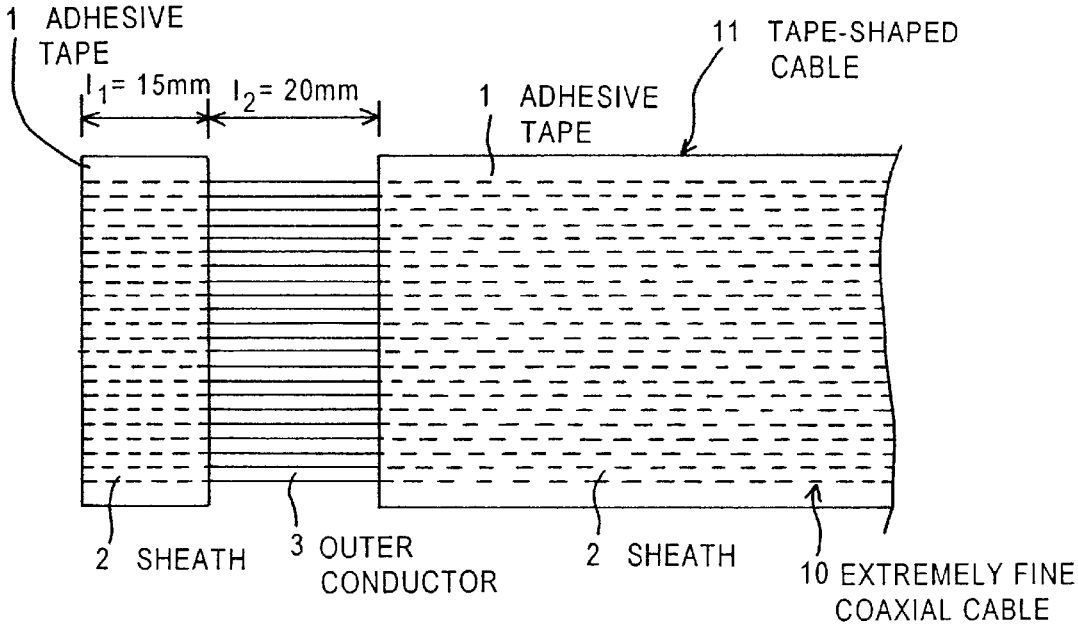
FIG. 2 is an explanatory view of a tape-shaped cable with the outer conductors exposed partially in a method for processing a terminal of a tape-shaped cable in an embodiment of the invention.

FIG. 2 shows a terminal portion of tape-shaped cable 11 having outer conductors 3 exposed. Then, the entirety of the exposed outer conductors (20 mm in length) are immersed in a solder bath to solder outer conductors 3 integrally and form a solder layer 4 (FIG. 3).

Figure 3:
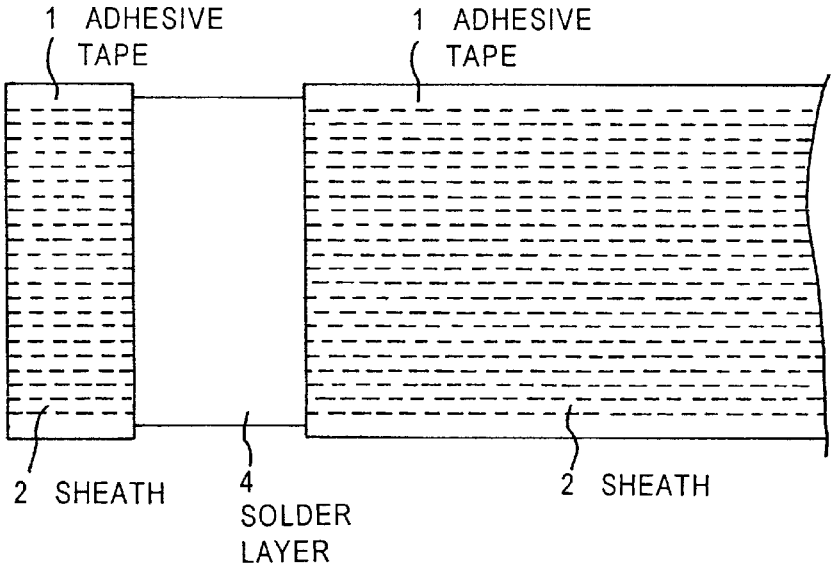
FIG. 3 is an explanatory view of a tape-shaped cable with the outer conductors soldered in a lump in the course of terminal-processing in an embodiment of the invention.

FIG. 3 shows the terminal portion of tape-shaped cable 11 having outer conductors 3 covered with solder layer 4. Then, laser light is irradiated in the middle of solder layer 4 covering outer conductors 3 entirely so as to form processing groove 5.

Figure 4:
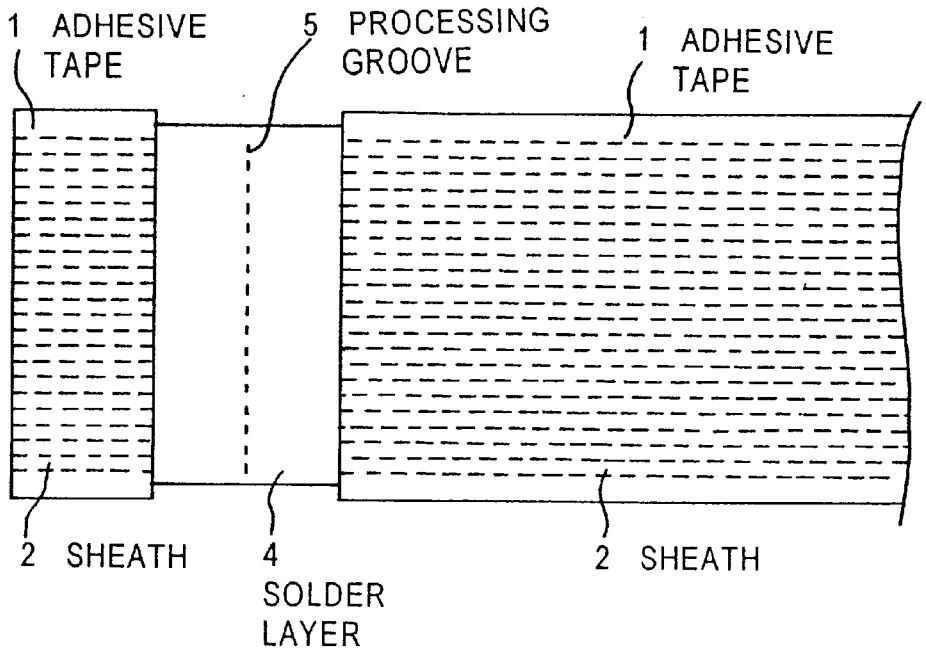
FIG. 4 is an explanatory view of a tape-shaped cable with a processing groove formed on the solder layer covering the outer conductors in the course of terminal-processing in an embodiment of the invention.

FIG. 4 shows the terminal portion of tape-shaped cable 11 having processing groove 5 formed on solder layer 4. A YAG laser used to form processing groove 5. The laser processing is carried out with a scanning rate ranging from 5 to 50 mm/sec., a Q-switching frequency ranging from 1 to 20 kHz and a lamp current ranging from 5 to 15 A.

Then, the cable is bent up and down with the fulcrum at processing groove 5 to cut outer conductors 3. Thereafter, outer conductors 3 which have been soldered are drawn to be removed integrally together with solder layer 4, so that insulative layers 6 are exposed (FIG. 5).

Figure 5:
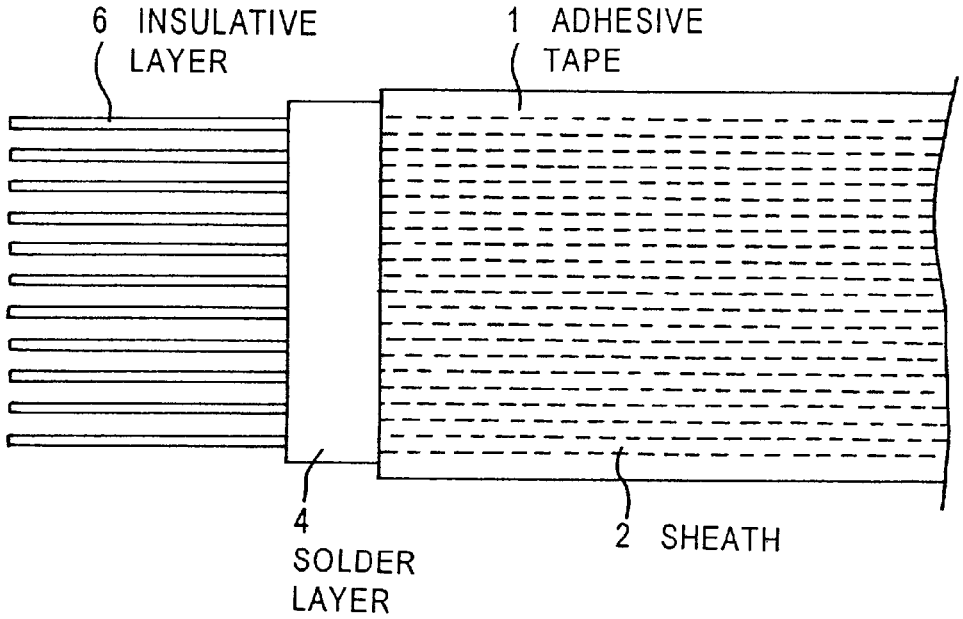
FIG. 5 is an explanatory view of a tape-shaped cable with the insulative layers exposed in the course of terminal-processing in an embodiment of the invention.

FIG. 5 shows the terminal portion of tape-shaped cable 11 having insulative layers 6 exposed. The cut surface of outer conductors 3 and solder layer 4 have irregularities (fine splits) because they are cut by bending. In order to hide such irregularities, outer conductors 3 having solder layer 4 thereon are sandwiched between two conductive plates 7 each composed of solder-coated flat copper plate of 1.5 mm in width and 0.15 mm in thickness in rectangular shape, so that two conductive plates 7 are soldered to be fixed on solder layer 4 (FIG. 6).

Figure 6:
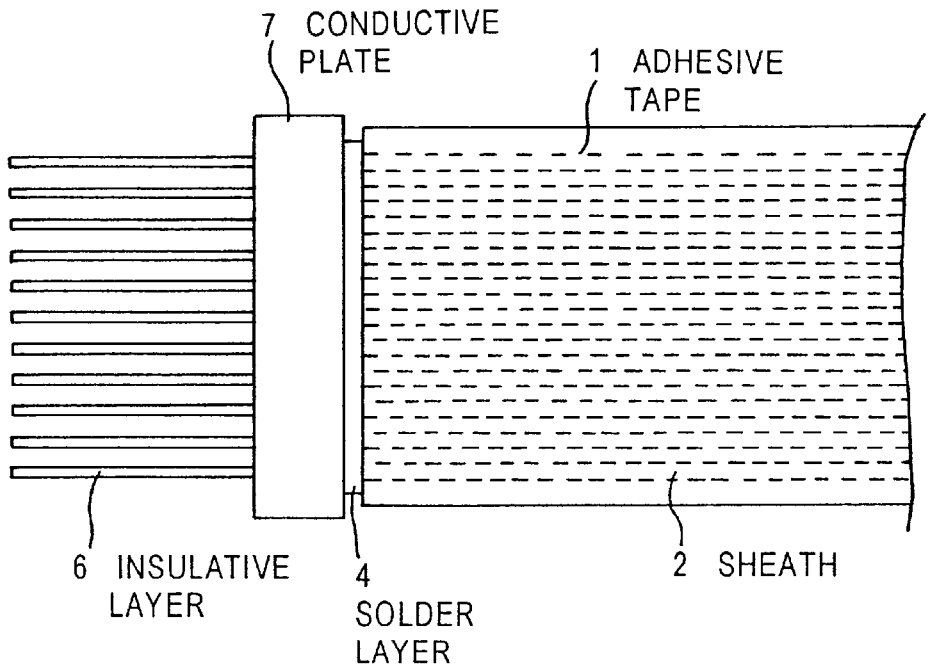
FIG. 6 is an explanatory view of a tape-shaped cable with a conductive plate soldered in the course of terminal-processing in an embodiment of the invention.

FIG. 6 shows the terminal portion of tape-shaped cable 11 sandwiched between conductive plates 7. Thus, flatness in the terminal surface of processed outer conductors is maintained, facilitating the alignment when the tape-shaped cable is applied to a connector.

Figure 7:
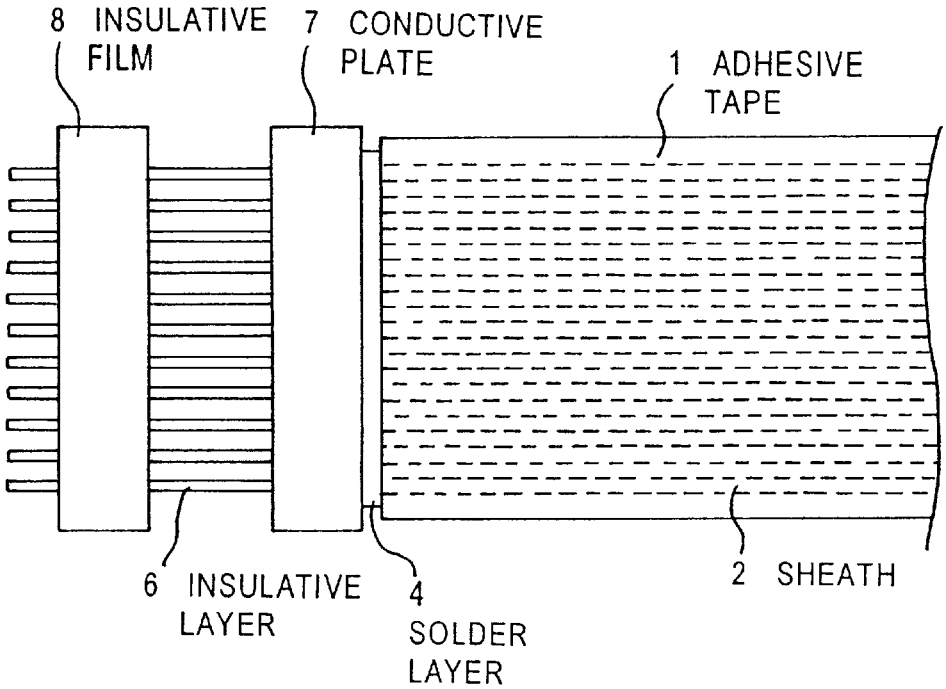
FIG. 7 is an explanatory view of a tape-shaped cable with plastic tape fixed by thermal adhesion on the insulated cores in the course of terminal-processing in an embodiment of the invention.

Next, an insulative film 8 is put on insulative layers 6 to be adhered to the latter with a predetermined pitch between the insulated cores, so that the insulated cores are fixed each other (FIG. 7).

FIG. 7 shows the terminal portion of tape-shaped cable 11 having insulative film 8 put on insulative layers 6. Then, slits are formed on insulative layers 6 at a position between insulative film 8 and conductive plate 7 by means of laser light ($CO_2$ laser). Thereafter, insulative film 8 is drawn to shift insulative layers 6 toward the end of the cable, so that inner conductors 9 are exposed (FIG. 8).

Figure 8:
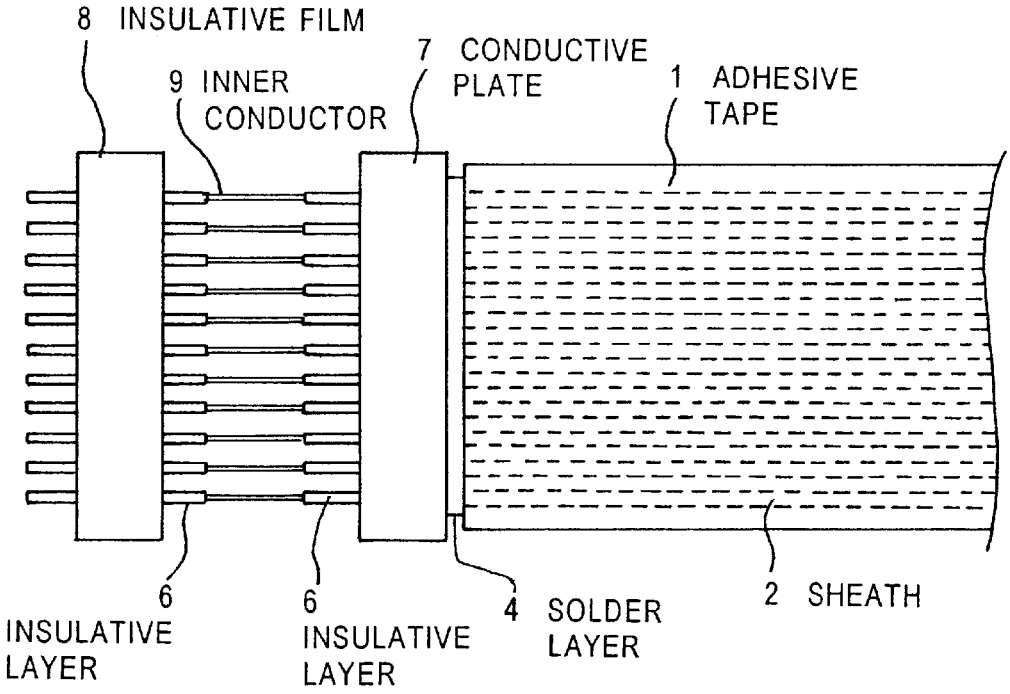
FIG. 8 is an explanatory view of a tape-shaped cable with the inner conductors exposed in the course of terminal-processing in an embodiment of the invention.

FIG. 8 shows the terminal portion of tape-shaped cable 11 having inner conductors 9 exposed after insulative layers 6 are shifted. At last, insulative layers extended out of insulative film 8 which serve to fix the pitch of insulative layers 6 are cut off, so that a terminal-processed tape-shaped cable is completed (FIG. 9).

Figure 9:
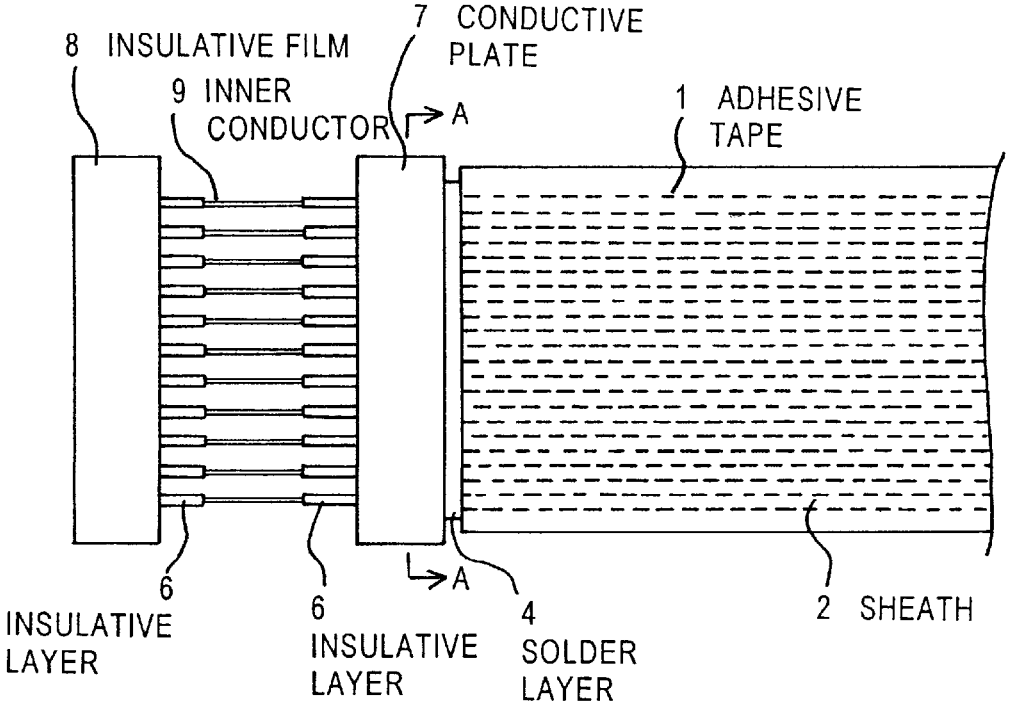
FIG. 9 is an explanatory view of a terminal-processed tape-shaped cable in an embodiment of the invention.

FIG. 9 shows the terminal-processed tape-shaped cable in the preferred embodiment of the invention.

Figure 10:
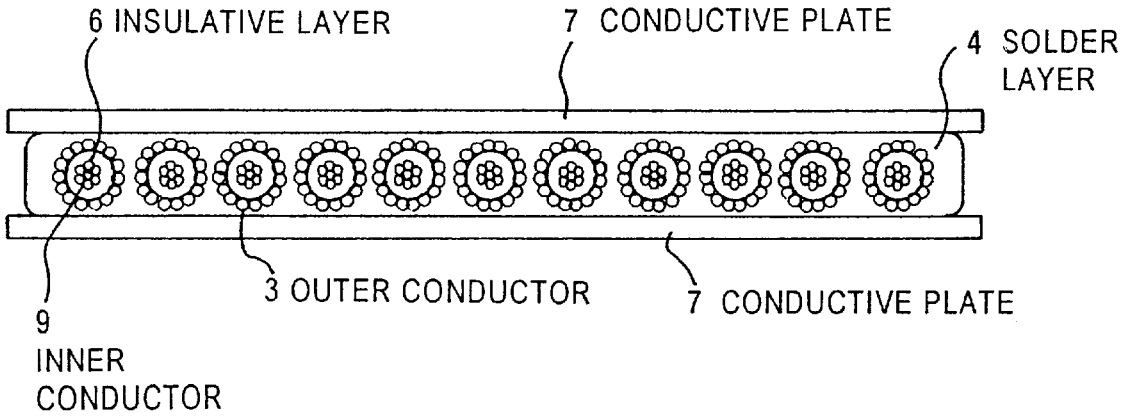
FIG. 10 is a cross-sectional view along line A—A in FIG. 9.

FIG. 10 is a cross-sectional view along line A—A in FIG. 9. As outer conductors 3 are soldered in a lump by means of solder layer 4, the pitch of inner conductors 9 is maintained accurately without disorders caused in the terminal process.

It is confirmed that no thermal effect due to laser light is caused on inner conductors 9 and insulative layers 6 covering them in the laser-radiating process in the embodiment above. Various lasers including YAG laser, $CO_2$ laser and EXIMA laser may be used in the process of the invention. With respect to the processing conditions, they are not limited to the ranges of processing conditions described in the preferred embodiment because various lasers in the market differ in their specification, parameters for processing and so on.

Otherwise, the processing groove on solder layer 4 may be formed by means of mechanical knives pressing solder layer 4 from above and below.

Conductive plate 7 may be single in number or may be omitted if the flatness of the terminal surface of the processed outer conductors is not required particularly.

According to the invention, a terminal-processed fine coaxial cable can be provided as an internal wiring material in an LCD improved in image quality.

Further, processing of the outer conductors is carried out very easily and simply because a processing groove is formed at a predetermined position of a solder layer produced by integral soldering of the outer conductors and then the outer conductors are separated mechanically at the processing groove and drawn off to be removed in a lump, whereby the terminal-processed cable is excellent in productivity.

Owing to a metal plate soldered on the outer conductors left after they are partially removed, not only the flatness of the terminal surface of the cable at the processed portion is maintained whereby connection of the cable with a connector is facilitated because of the ease in alignment, but also grounding of the outer conductors is ensured.

Although the invention has been described with respect to specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. A terminal-processed structure of a tape-shaped cable including a plurality of coaxial cables arranged in parallel, comprising:

inner conductors arranged in parallel with a predetermined pitch;

insulative layers for insulating said inner conductors except for predetermined portions thereof, thereby providing exposed inner conductors each having a predetermined length;

outer conductors provided on said insulative layers except for predetermined portions thereof, thereby providing exposed insulative layers on both sides of said exposed inner conductors;

a solder layer for covering said outer conductors, said solder layer having opposite flat surfaces;

grounding plates soldered to be fixed on said opposite flat surfaces of said solder layer, such that any irregularities present on cut surfaces of said outer conductors and said solder layer are covered and a connecting surface for said cable is smooth;

sheaths provided on outer peripheries of said outer conductors at positions where said solder does not cover said outer conductors; and insulative tapes for arranging said plurality of coaxial cables in parallel with said predetermined pitch, said insulative tapes adhering to said sheaths, and each coaxial cable including one of said inner conductors, one of said insulative layers, one of said conductors, and one of said sheaths.

2. The terminal-processed structure of a tape-shaped cable as defined in claim 1, wherein:

said insulative layers are fixed at tip ends thereof by insulating film adhered to said insulating layers to keep said predetermined pitch.

* * * * *